US008398108B2

(12) United States Patent
Andrews

(10) Patent No.: US 8,398,108 B2
(45) Date of Patent: Mar. 19, 2013

(54) TRANSFER CHAIR

(76) Inventor: Michelle Andrews, Parkersburg, WV (US)

( * ) Notice: Subject to any disclaimer, the term of this patent is extended or adjusted under 35 U.S.C. 154(b) by 310 days.

(21) Appl. No.: 12/797,080

(22) Filed: Jun. 9, 2010

(65) Prior Publication Data

US 2011/0304186 A1 Dec. 15, 2011

(51) Int. Cl.
*A61G 5/10* (2006.01)

(52) U.S. Cl. ..... 280/304.1; 280/250.1

(58) Field of Classification Search ..... 280/304.1, 280/250.1; 5/83.1, 86.1, 87.1, 81.1 HS, 81.1 T, 5/81.1 R; 297/314, 339, 344.16
See application file for complete search history.

(56) References Cited

U.S. PATENT DOCUMENTS

| | | | | |
|---|---|---|---|---|
| 1,748,784 | A | 2/1930 | Mierley | |
| 3,038,174 | A | 6/1962 | Brown et al. | |
| 4,477,117 | A | 10/1984 | Higgs | |
| 4,716,607 | A * | 1/1988 | Johansson | 5/81.1 T |
| 4,726,082 | A * | 2/1988 | DiMatteo et al. | 5/81.1 C |
| 4,737,997 | A * | 4/1988 | Lamson | 5/87.1 |
| 4,821,352 | A * | 4/1989 | DiMatteo et al. | 5/81.1 C |
| 4,856,123 | A | 8/1989 | Henderson et al. | |
| 4,934,723 | A | 6/1990 | Dysarz | |
| 4,987,620 | A * | 1/1991 | Sharon | 5/600 |
| 4,997,200 | A | 3/1991 | Earls | |
| 5,048,133 | A | 9/1991 | Iura et al. | |
| 5,137,295 | A | 8/1992 | Peek | |
| 5,179,745 | A * | 1/1993 | Hebert et al. | 5/620 |
| 5,195,803 | A * | 3/1993 | Quintile | 297/365 |
| 5,209,322 | A * | 5/1993 | McMahon | 180/271 |
| 5,269,588 | A * | 12/1993 | Kunz et al. | 297/322 |
| 5,297,834 | A * | 3/1994 | Vanarnem | 294/140 |
| 5,319,813 | A * | 6/1994 | DiMatteo et al. | 5/81.1 C |
| 5,584,082 | A | 12/1996 | Crawford et al. | |
| 5,596,775 | A * | 1/1997 | DiMatteo et al. | 5/81.1 C |
| 5,664,266 | A * | 9/1997 | Williams et al. | 5/86.1 |
| 6,224,156 | B1 | 5/2001 | Fleigle | |
| 6,315,319 | B1 | 11/2001 | Hanson et al. | |
| 6,325,399 | B1 * | 12/2001 | DeMoss | 280/250.1 |
| 6,431,650 | B1 | 8/2002 | Visone | |
| 6,496,991 | B1 * | 12/2002 | Votel | 5/81.1 HS |
| 6,793,232 | B1 * | 9/2004 | Wing | 280/304.1 |
| 6,846,042 | B2 | 1/2005 | Hanson et al. | |
| 7,144,026 | B2 | 12/2006 | Kao | |
| 7,306,251 | B2 | 12/2007 | Bright et al. | |
| 7,547,031 | B2 | 6/2009 | Moran et al. | |
| 2002/0149168 | A1 | 10/2002 | Brown | |
| 2002/0170110 | A1 * | 11/2002 | Hodgetts | 5/86.1 |
| 2003/0184042 | A1 * | 10/2003 | Patrick et al. | 280/250.1 |
| 2005/0087968 | A1 * | 4/2005 | Bennett et al. | 280/755 |
| 2005/0104319 | A1 * | 5/2005 | Wing | 280/250.1 |
| 2007/0056096 | A1 | 3/2007 | Assink | |
| 2007/0124859 | A1 * | 6/2007 | Stryker et al. | 5/81.1 R |
| 2008/0133089 | A1 * | 6/2008 | Bayomy et al. | 701/49 |

* cited by examiner

*Primary Examiner* — Tashiana Adams
(74) *Attorney, Agent, or Firm* — Wood, Herron & Evans, LLP

(57) ABSTRACT

A transfer chair and a method of using the same. The transfer chair includes a base frame, a seat frame, and a seat having a front edge and a back edge and that is supported by the seat frame. A vertical lift mechanism couples the base frame to the seat frame and is configured to translate the seat from a first height to a second height. A seatback extends upwardly from the back edge of the seat in a first configuration and extends downwardly from the back edge of the seat in a second configuration. When the seatback is in the second configuration, a patient may slide over the back edge of the seat. A transition mechanism moves the seatback between the first and second configurations.

21 Claims, 16 Drawing Sheets

TRANSFER CHAIR

TECHNICAL FIELD

The present invention relates generally to a transfer chair designs and, more particularly, to transfer chair designs that facilitate the transfer of a patient.

BACKGROUND

Wheelchairs are conventional tools used to facilitate the mobility of those persons having a disability, injury, or illness that increases the difficulty of walking. The basic components of a wheelchair include a seat, a seatback, and four wheels, yet additional features may be included and have been developed around these basic components. Depending on the particular features included, the wheelchair may be broadly classified as either a manual chair or a powered chair. Manual chairs are propelled by human-applied force, whether the force is applied by the patient from within the chair or by the patient's attendant from behind the wheelchair. Powered chairs include a motor and power source that are mechanically coupled to the wheels in order to propel the chair in a particular direction. Another version of the powered chair, known as a mobility-scooter, provides more elaborate features that facilitate the patient's use and increases the patient's comfort.

However, the patient cannot spend their entire life restricted to the wheelchair. Instead, it is often necessary to move the patient from the wheelchair. For example, wheelchairs are not easily accommodated by conventional automobiles. Therefore, some wheelchairs collapse, or fold, so that the wheelchair is transported separate from, but with, the patient. While collapsible wheelchair designs have been useful in accommodating automobile travel, the issue of transferring the patient to and from the wheelchair remains. This issue is not limited to automobile travel, but extends to daily routines such as physical examinations and daily hygiene practices.

One manner of transferring the patient to and from the wheelchair is accomplished by embracing the patient from under the arms, such as giving a "bear hug," and manually lifting the patient. However, depending on the nature of the patient's disability or injury and the level of assistance that the patient is able to provide, this could be a "dead lift" for the patient's attendant, posing the threat of serious injury to both the patient and the patient's attendant.

To alleviate the strain on the patient's attendant, a mechanical lift may be used. The mechanical lift generally includes a handlebar grasped by the patient or a sling positioned around a portion of the patient's body. The mechanical lift may then be used to elevate and swivel the patient from one location to another.

Use of either of the manual and mechanical lift methods may cause at minimum physical discomfort to the patient, but may also cause skin shearing or bruising at the areas grasped for transfer. As a result, some wheelchairs have been designed to convert into a stretcher, which permits a supine-directed transfer of the patient. Still, these designs are often quite expensive due to the engineering required to design the conversion. Additionally, because the transfer may only be from the supine position, a large area is required for use of these designs.

While wheelchair designs have greatly increased the mobility of patients, there is needed development and design that aid in the transfer of the patient without the threat of injury and while maintaining the dignity of the patient. There is further need for a transfer mechanism that is readily adaptable to current wheelchair designs and without excessive engineering that ultimately increases the cost of the wheelchair. Preferably, the design would be readily applicable to all varieties of wheelchair designs, including manual chairs, powered chairs, and mobility-scooters.

SUMMARY

In one illustrative embodiment, the present invention is directed to a transfer chair. The transfer chair includes a base frame, a seat frame, and a seat having a front edge and a back edge and that is supported by the seat frame. A vertical lift mechanism couples the base frame to the seat frame and is configured to translate the seat from a first height to a second height. A seatback extends upwardly from the back edge of the seat in a first configuration and extends downwardly from the back edge of the seat in a second configuration. When the seatback is in the second configuration, a patient may slide over the back edge of the seat. A transition mechanism moves the seatback between the first and second configurations.

In another illustrative embodiment, the present invention is directed to a method of using the transfer chair. Accordingly, the seat of the transfer chair is elevated to a height that is similar to a height of a platform. The transfer chair is positioned such that the back edge of the seat is adjacent to an edge of the platform. The patient is then transferred between the transfer chair and the platform by sliding the patient over the back edge of the seat.

DETAILED DESCRIPTION

Figure 1:
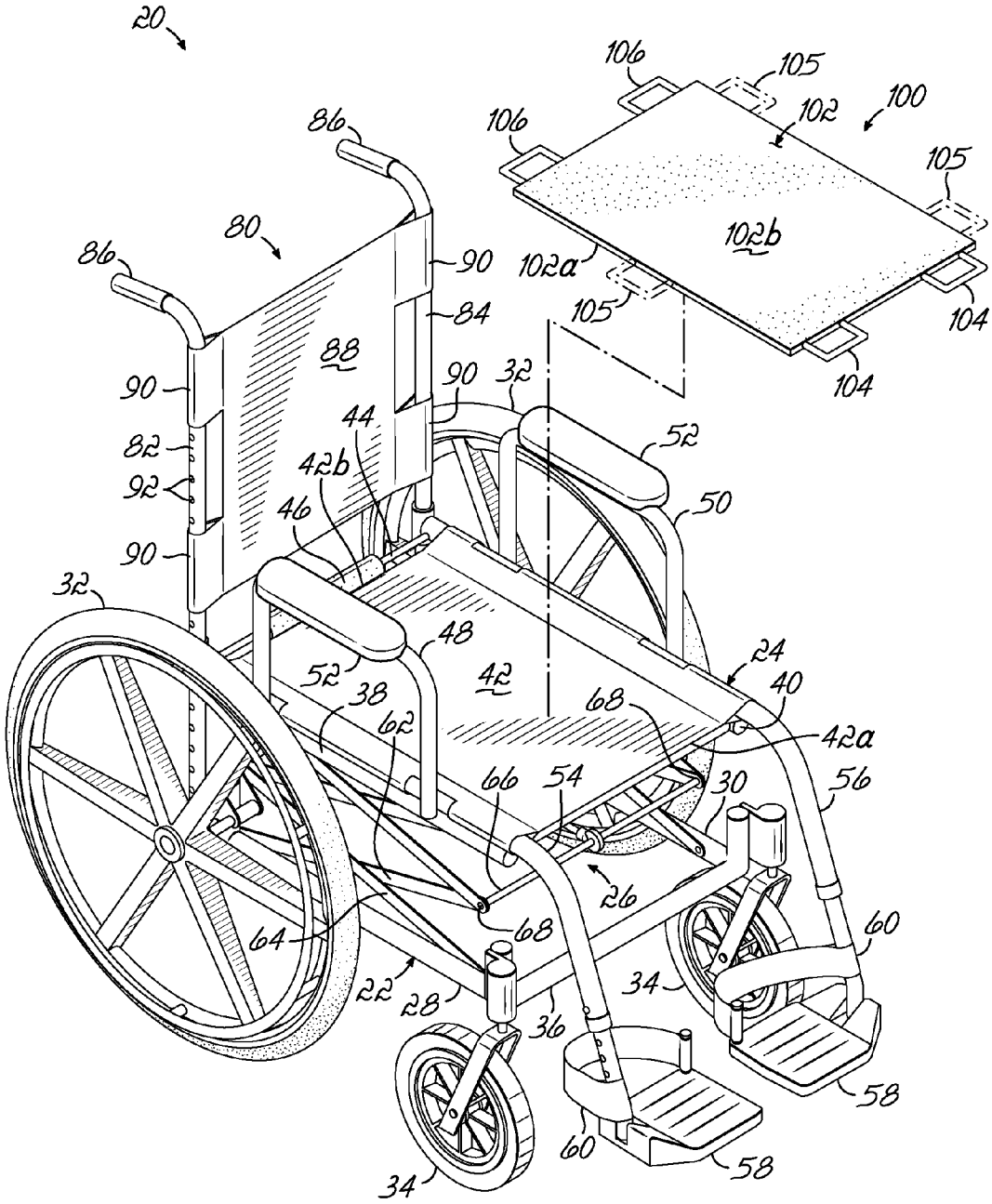
FIG. 1 is a perspective view of one exemplary embodiment of a wheelchair with an illustrative embodiment of a seatback transition mechanism in accordance with the present invention.

FIG. 1 illustrates a wheelchair 20 in accordance with one embodiment of the present invention. The wheelchair 20 includes a base frame 22, a seat frame 24, and a vertical lift mechanism 26 coupling the base frame 22 to the seat frame 24. The base frame 22 may include two tubular side members 28, 30, positioned in parallel and each having a larger rear wheel 32 and a smaller front wheel 34 rotatably coupled thereto. One or more cross-members 36 extend between the two tubular side members 28, 30 to provide structural support and frame rigidity. However, it would be understood that in collapsible embodiments of the wheelchair (not shown), the one or more cross-members 36 may be telescoping, jointed, or absent in order to facilitate the folding. Generally, the tubular side members 28, 30 of the base frame 22 will be constructed from a sufficiently strong metallic pipe, such as aluminum; however, other structural materials may also be used.

The seat frame 24 includes at least two side support members 38, 40 such that a seat 42, illustrated here as a sheet of upholstery fabric, extends between the two side support members 38, 40 in a manner that is similar to a sling. Though not shown, it would be understood that the seat 42 may alternatively be an upholstered pad affixed to a planar support and coupled to the side support members 38, 40 by bolts or screws. In either of these embodiments, the upholstery fabric may be a cotton or polyester blend, nylon, or vinyl, or other, as desired by the patient for comfort and for ease of cleaning. Other seat construction designs and materials are known and may be used as desired or necessary.

Cross-bars and support members may extend between the two side support members 38, 40 for structural stability and as necessary to support the weight of the patient. FIG. 1 illustrates a cross-bar 44 extending between the two side support members 38 near a back edge 42*b* of the seat 42. The cross-bar 44 includes a rotating pad 46 that surrounds the cross-bar 44 and is rotatable relative to the cross-bar 44. The cross-bar 44 with the rotating pad 46 may aid in transferring the patient to and from the wheelchair 20 in a manner provided in greater detail below. While not specifically shown, it would be understood that an additional cross-bar and rotating pad may be included at a front edge 42*a* of the seat 42.

The seat frame 24 may, as shown, include U-shaped posts 48, 50 having padded arm rests 52 thereon for enhancing the comfort of the patient. The particular design of the arm rests 52 should not be limited to the particular illustrative embodiments shown and described herein. Additionally, the seat frame 24 may include a pair of legs 54, 56 that may extend angularly downward from the side support members 38, 40 and terminate in a foot rest 58. While various foot rest constructions are known and may be used in association with the present invention, the particular embodiment shown includes a hinged assembly for coupling the foot rest 58 to the legs 54, 56. A heel brace 60 extending radially around the rear portion of the foot rest 58 secures the heel of the patient when the foot is positioned on the foot rest 58.

The base frame 22 and seat frame 24 are coupled by the vertical lift mechanism 26, which is illustrated in FIG. 1 as pair of lateral scissors. Each of the lateral scissors is positioned just medial to the rear wheels 32 and includes two v-shaped braces 62, 64. Each v-shaped brace 62, 64 has a first end coupled to the tubular side members 28, 30 of the base frame 22 and a second end coupled to the side support members 38, 40 of the seat frame 24 such that the two v-shaped braces 62, 64 form a crisscrossed pattern lateral to each of the rear wheels 32. Two cross-bars couple the respective joints 68, 69 (rear medial joint 69 shown in FIG. 2) of the v-shaped braces 62, 64.

Figure 1A:
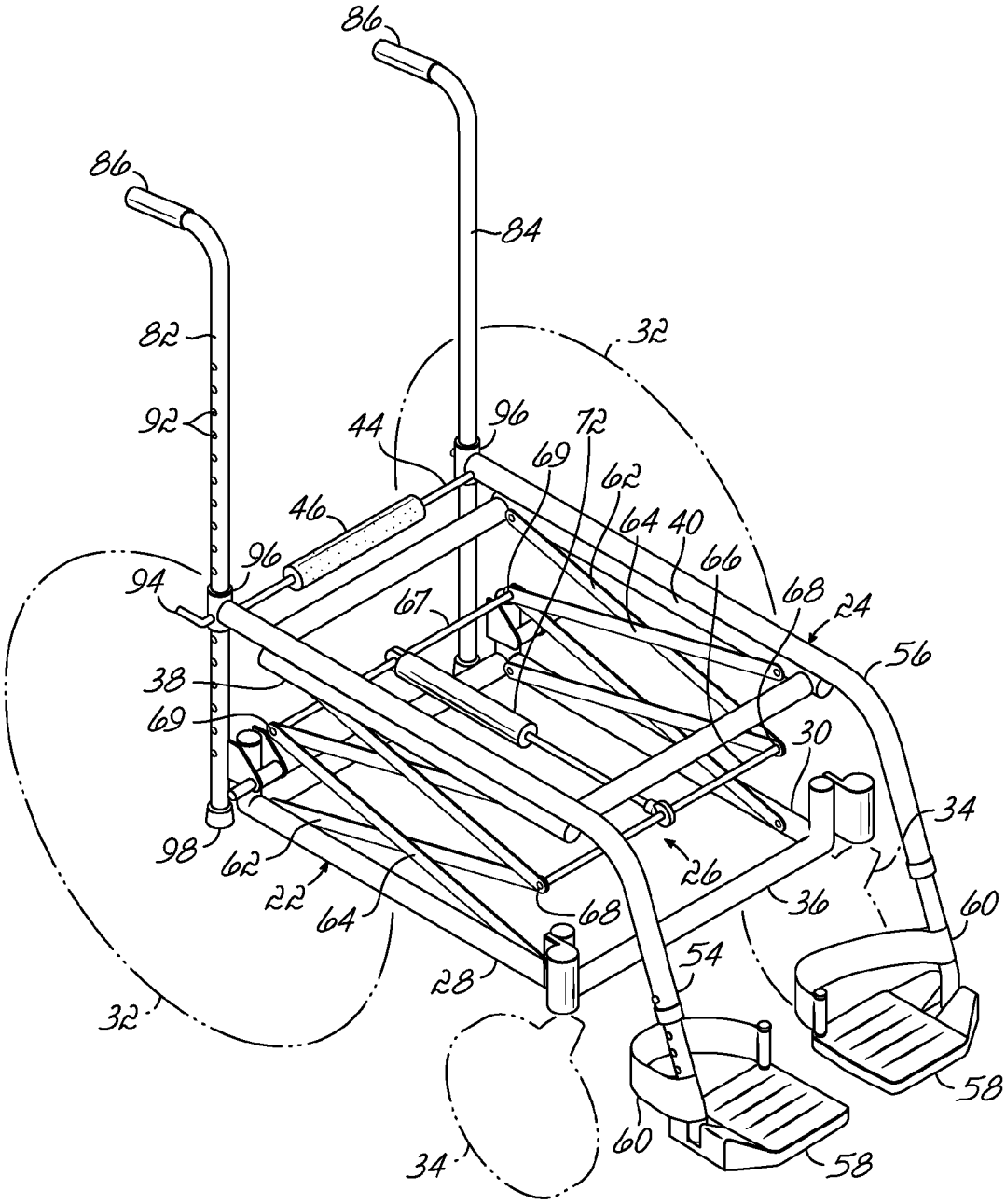
FIG. 1A is a perspective view of the wheelchair of FIG. 1 with the seat and the seatback removed and the wheels shown in phantom.
Figure 2:
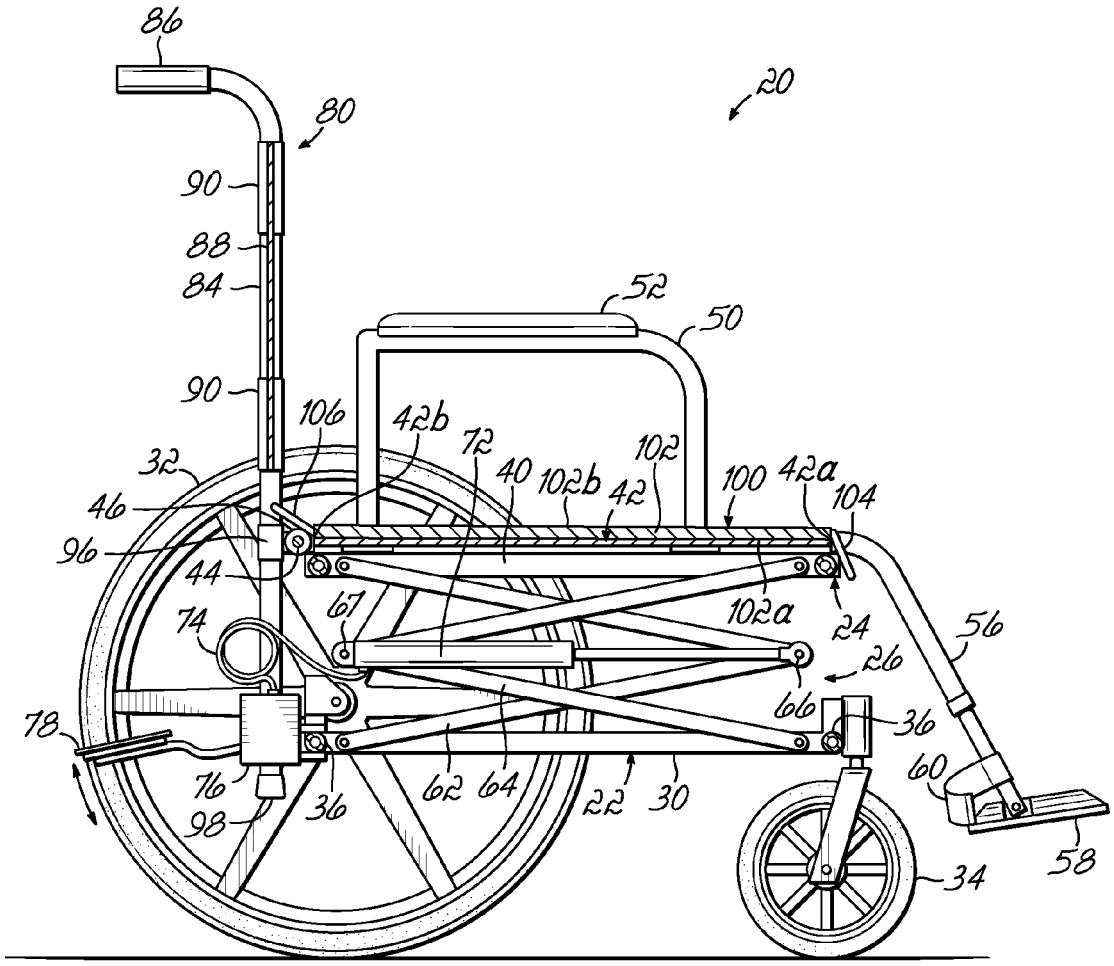
FIGS. 2-3 are side elevational views of the exemplary embodiment illustrated in FIG. 1, shown in partial cross-section.
Figure 3:
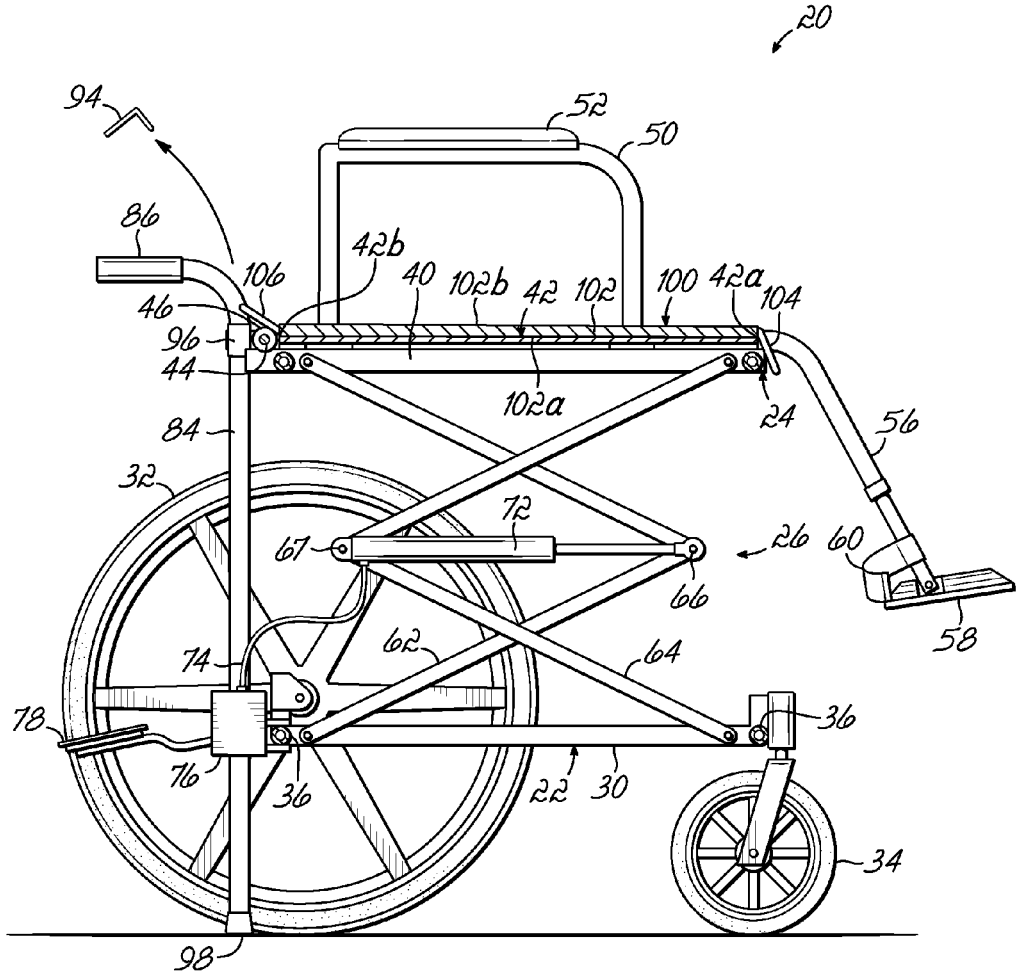

With continued reference to FIG. 1 and also FIGS. 1A, 2, and 3, a piston 72, shown to be positioned centrally between the dual lateral scissors, couples the cross-bars 66, 67 at about their respective mid-points. The piston 72 is coupled via a line 74 and suitable couplers (not shown) to a hydraulic pump 76. A foot pedal 78 activator is coupled to the hydraulic pump 76 for actuating the hydraulic pump 76 in a manner that is known to those of ordinary skill in the art. To move the seat frame 24 from a lower position, shown in FIG. 2, to a higher position, shown in FIG. 3, the foot pedal 78 is activated by successively pumping the foot pedal 78, thereby building pressure within the hydraulic pump 76 and causing a shortening of the piston 72. By shortening the piston 72, an inwardly-directed force is applied to the medial joints 68, 69 of each of the scissors to elongate the crisscross pattern and propel the seat 42 upward (FIG. 3). To again lower the seat 42, the pressure within the hydraulic pump 76 is released when the foot pedal 78 is depressed and held. This loss of pressure allows the piston 72 to extend and release the inwardly-directed force on the medial joints 68, 69. The seat frame 24 moves downward (shown in FIG. 2) as the crisscross patterns collapse.

Returning again to FIG. 1, the illustrated embodiment of the wheelchair 20 includes a seatback assembly 80 coupled to the back edge 42*b* of the seat 42. The seatback assembly 80 includes two side members 82, 84 extending vertically upward from the back edge 42*b* of the seat 42. At an end opposing the seat 42, the side members 82, 84 may turn rearwardly by approximately 90° and receive handle grips 86. Various designs of handle grips 86 are known and the present invention should not be limited to any particular hand grip embodiment or design.

The seatback assembly 80 includes a seatback 88 that may be constructed from a sheet of an upholstery fabric extending between the side members 82, 84. Accordingly, the upholstery fabric may include at least one sleeve 90 on each side for receiving the side supports where the sleeves may include snaps, VELCRO brand of couplers, or some other manner of removing the fabric. Alternatively, it would be understood that the seatback 88 may include a planar structure (not shown) that is directly coupled to the side members 82, 84 with or without padding for additional patient comfort. Various other embodiments of seatbacks are known and should not be considered to be limiting.

The seatback assembly 80 is configured to transition from a first configuration where the seatback 88 extends upwardly from the back edge 42*b* of the seat 42 (shown in FIGS. 1 and 2) to a second configuration where the seatback 88 extends downwardly from the back edge 42*b* of the seat 42 (shown in FIG. 3).

Referring to FIGS. 1, 1A, 2, and 3, where one embodiment of a transition mechanism for transitioning the seatback between the first and second configurations is shown. The transition mechanism includes at least one aperture 92 (a plurality of apertures are shown) extending vertically along each side member 82, 84 of the seatback assembly 80 and configured to receive a pin 94 (FIGS. 1A, 3). Each side member 82, 84 is received by a rigid sleeve 96 that is vertically affixed to the back of the two side support members 38, 40 of the seat frame 24. The rigid sleeve 96 includes an aperture (not shown) so that as the side members 82, 84 slide relative to the side support members 38, 40, the at least one aperture 92 aligns with the aperture of the rigid sleeve 96.

When so aligned, the pin 94 is positioned to extend through aligned apertures to retain a position of the seatback 88 relative to the seat 42.

To move the seatback assembly 80 into the second configuration, the patient's attendant removes the seatback 88 by disengaging the snaps or VELCRO or the particular attachment mechanism. The pin 94 is removed from the aligned apertures such that the side members 82, 84 may slide relative to the rigid sleeve 96. When a desired height is achieved, one of the apertures 92 is aligned with the aperture in the rigid sleeve 96 and the pin 94 is positioned through aligned apertures to resist further telescopic movement. Alternatively, the side members 82, 84 may slide until the bottom of the side members 82, 84 resides on the floor. Accordingly, the bottom of each of the side members 82, 84 may include a tip 98 such that when the seatback 88 is completely lowered, the tip 98 will reside on and protect the floor, as shown in FIG. 3.

Figure 1B:
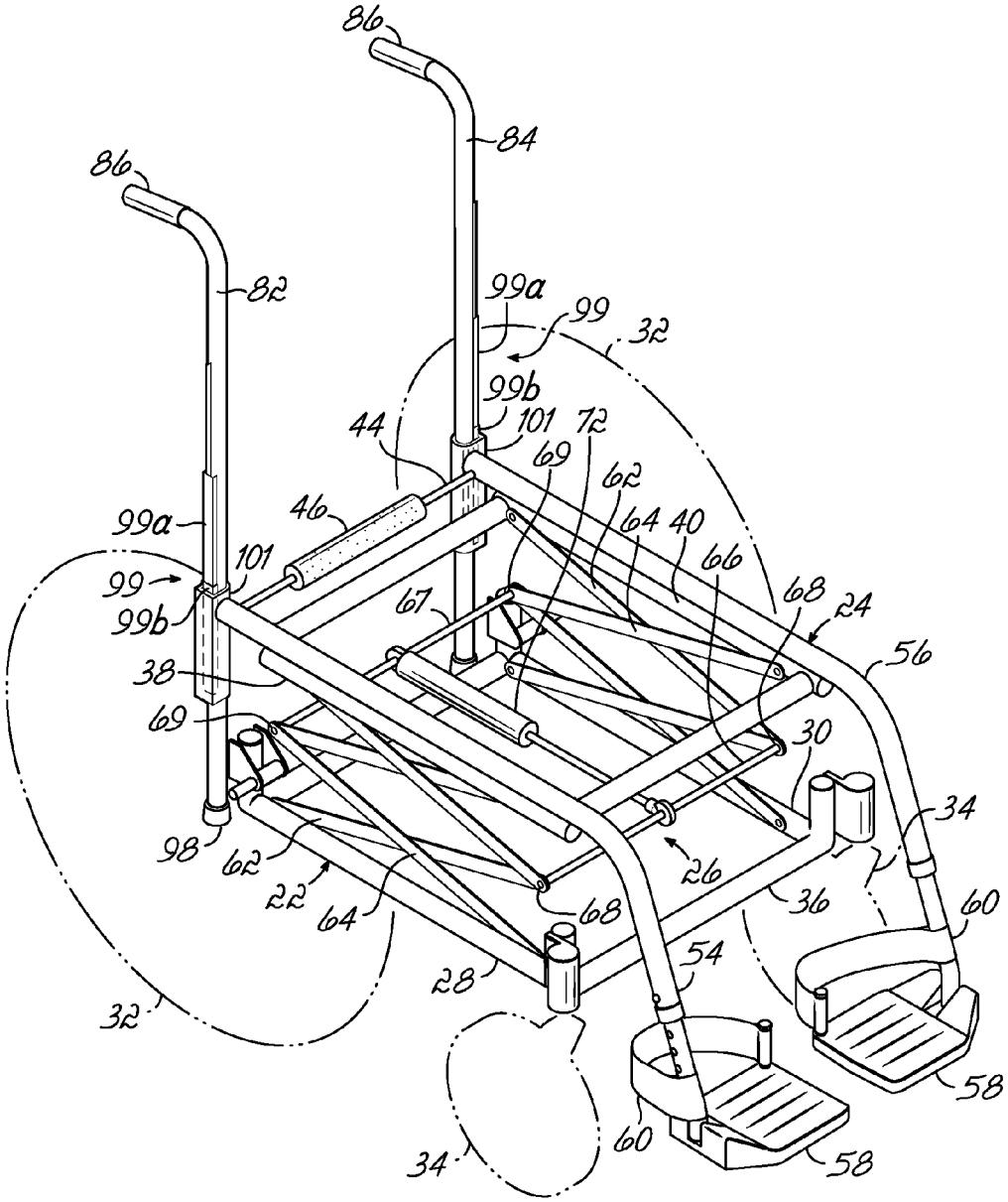
FIG. 1B is a perspective view of an alternate embodiment of the seatback transition mechanism.

FIG. 1B illustrates an alternate embodiment of the transition mechanism and includes a drawer mechanism 99 with a first portion 99*a* of the drawer mechanism 99 being coupled to the side members 82, 84 and a second portion 99*b* is coupled to an elongated sleeve 101

FIG. 1 further illustrates a transfer mat 100 comprised of a planar surface 102 having an area that substantially matches the area of the seat 42 and includes at least one grip, though two forward grips 104, two rearward grips 106 and three side grips 105 are shown. The planar surface 102 may include a two-layer construction where a lower surface 102*a* includes a slippery material or coating (such as TEFLON) and an upper surface 102*b* is constructed from a hypoallergenic material that may be sanitized. The grips 104, 106 may be rigid, such as a molded polymeric material, or fabric straps that are sewn into the fabric comprising the planar surface 102. Other construction materials and configurations would be known beyond those specifically shown herein.

Figure 4A:
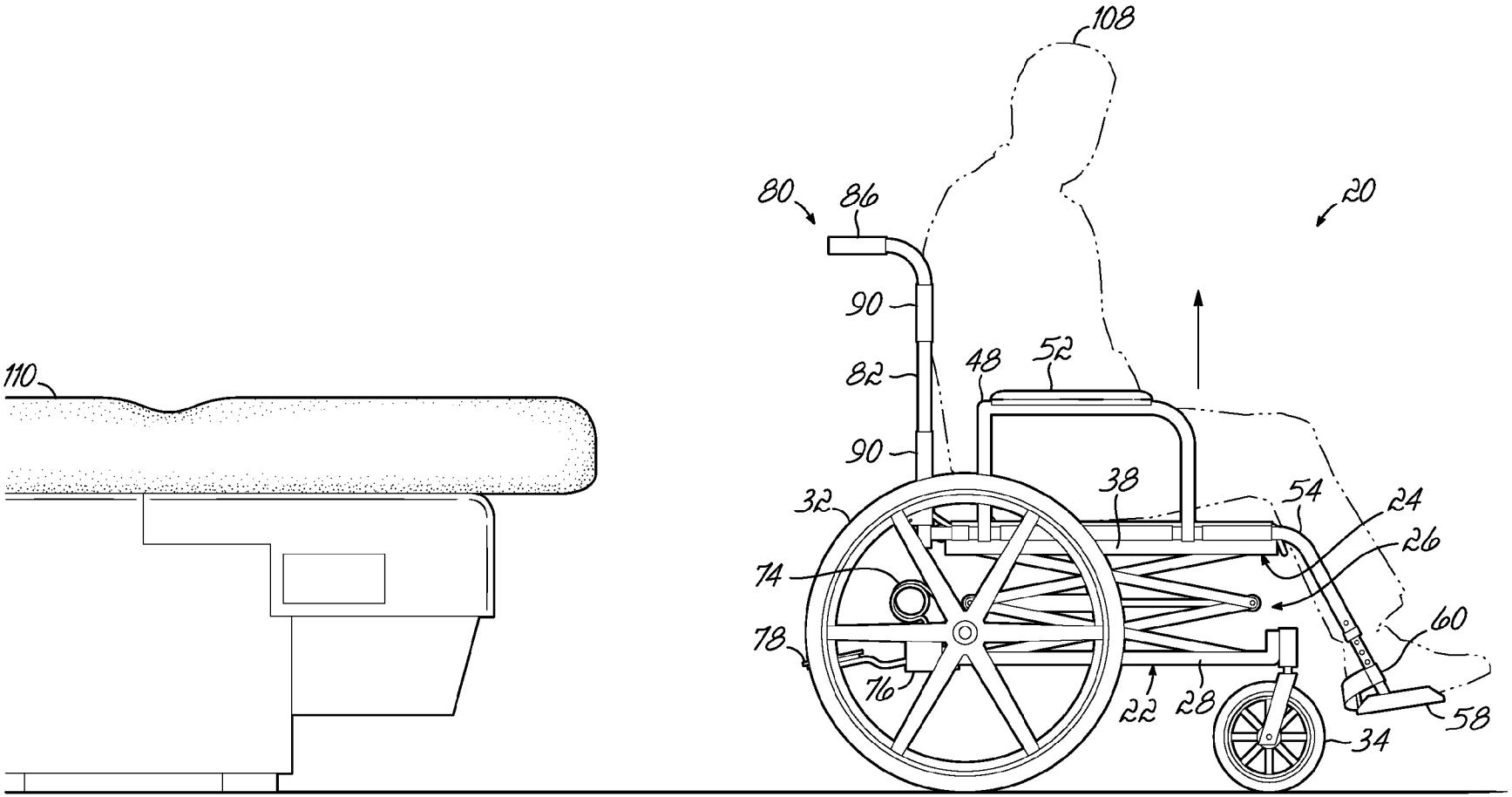
FIGS. 4A-4E are side elevational views illustrating successive steps of one method of transferring a patient from the wheelchair illustrated in FIG. 1 to an examining table in accordance with one embodiment of the present invention.
Figure 4B:
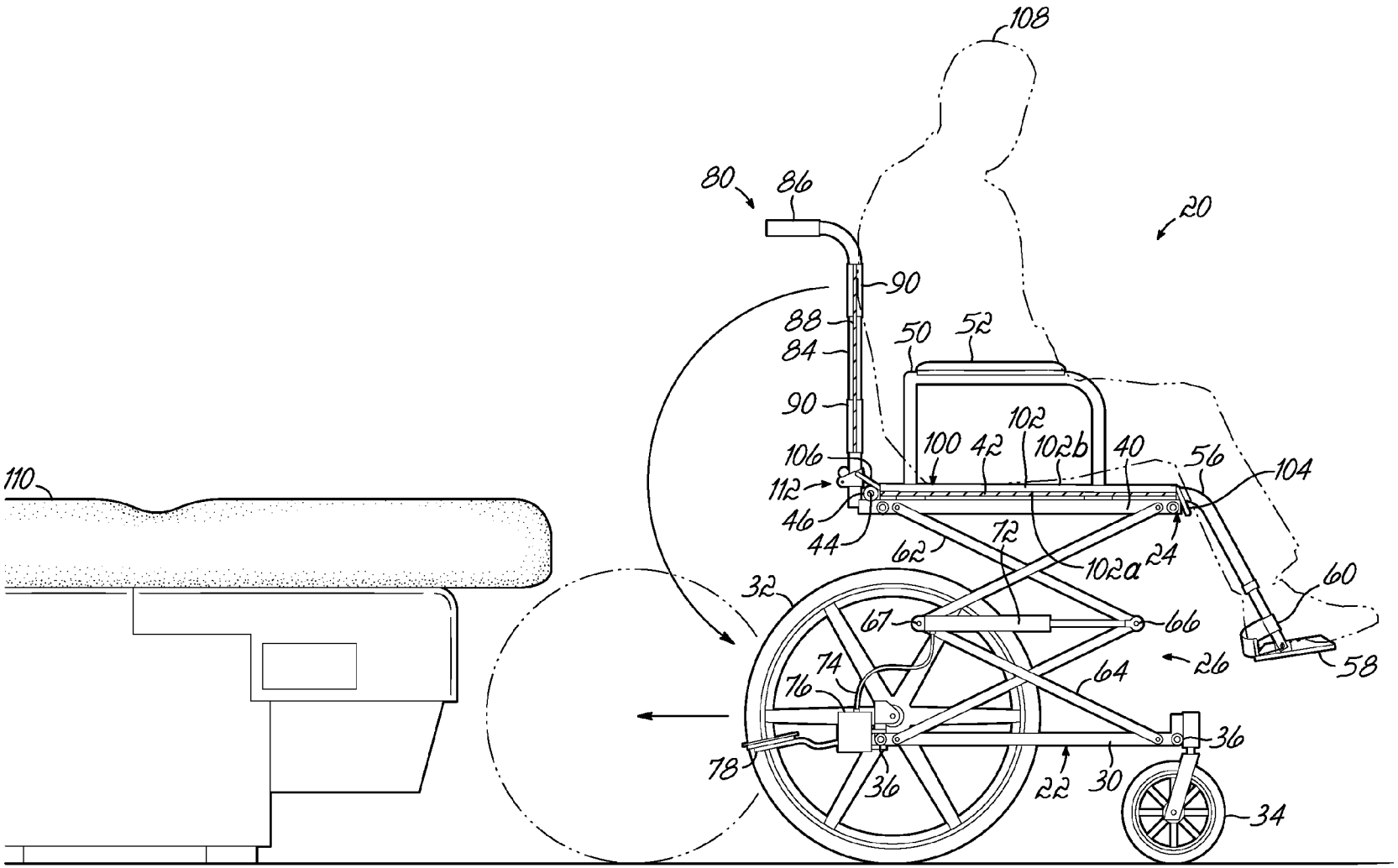
Figure 4C:
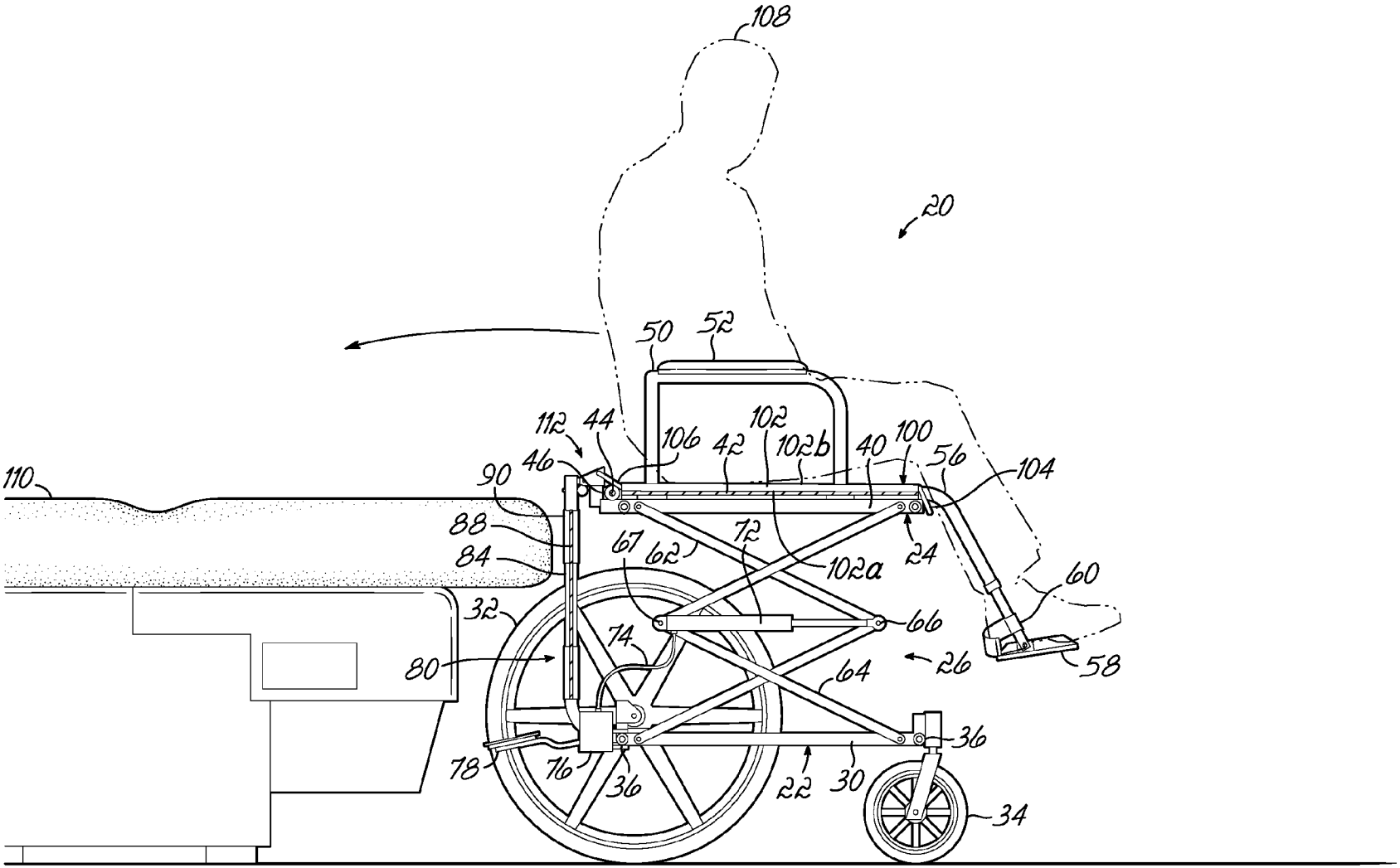

With the details of the wheelchair 20 described with some detail and with reference to FIGS. 4A-4E, successive steps of one illustrative method of using the wheelchair 20 may be shown and described with greater detail, and where like reference numerals refer to like parts illustrated in FIGS. 1-3. As shown, a patient 108 that is seated within the wheelchair 20 may be required to move to another platform, illustrated here as an examining table 110 but could also include a gurney, other chairs, etc. The patient's attendant (not shown), which may be a nurse or other healthcare provider, a family member, or a caretaker, activates the vertical lift mechanism 26 until the seat frame 24 is substantially co-planar with a plane defined by a top surface of the examining table 110, as shown in FIG. 4B. The transition mechanism is activated such that the seatback 88 moves from the upwardly-directed first configuration (FIG. 4B) to a downwardly-directed second configuration (FIG. 4C). While this may be accomplished with the sliding mechanism shown in FIG. 1, a rotational configuration 112 is specifically shown herein and with greater detail in FIGS. 5A-5D.

Figure 5A:
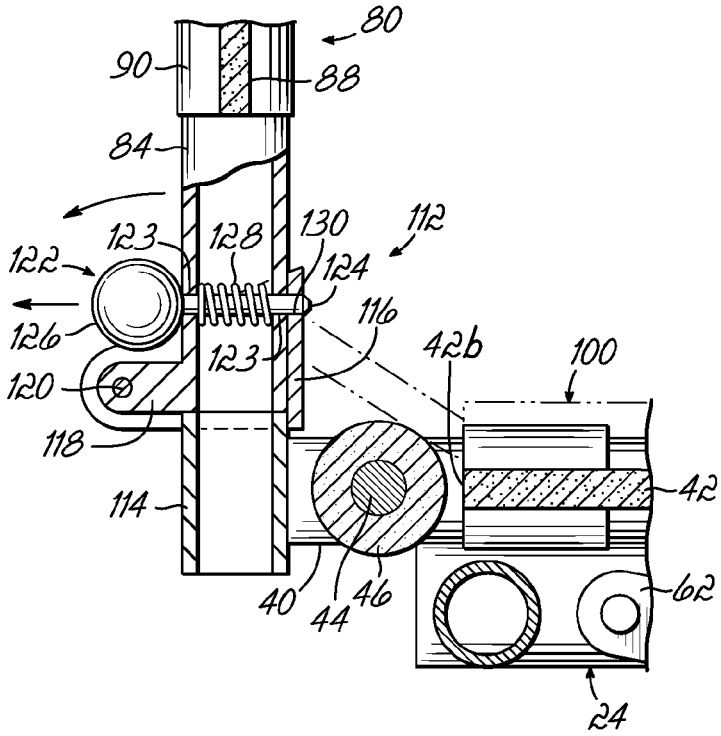
FIGS. 5A-5D are side elevational views illustrating successive steps of one exemplary manner of moving the seatback from a first configuration to a second configuration.

In FIG. 5A, the rotational configuration 112 is shown to further include a supporting member 114 affixed to the back portion of the side support members 38, 40 of the seat frame 24. A shield member 116 extends upwardly from the supporting member 114 and is constructed with an angular edge. While only the side member 84 is shown, it would be understood that an additional rotational configuration 112 would also be included on side member 82 (FIG. 1).

The side member 84 of the seatback 88 includes an extension 118 that is rotatably coupled to the back edge of the shield member 116 at a pivot point, designated by a pin 120. A spring-loaded pin 122 extends through first and second diametrically opposed apertures 123*a*, 123*b* of the side member 84 with a protrusion 124 extending beyond the first aperture 123*a*, a grasp point 126 extending beyond the second aperture 123*b*, and the springing member 128 encircling the spring-loaded pin 122 within the lumen of the side member 84. The springing member 128 is biased such that the protrusion 124 is fully extended beyond the first aperture 123*a* and into an aperture 130 within the shield member 116 when the springing member 128 is in its resting position. While the grasp point 126 is shown to have a spherical shape, it would be readily understood that other shapes are possible, including rings, hooks, tabs, and so forth.

Figure 5B:
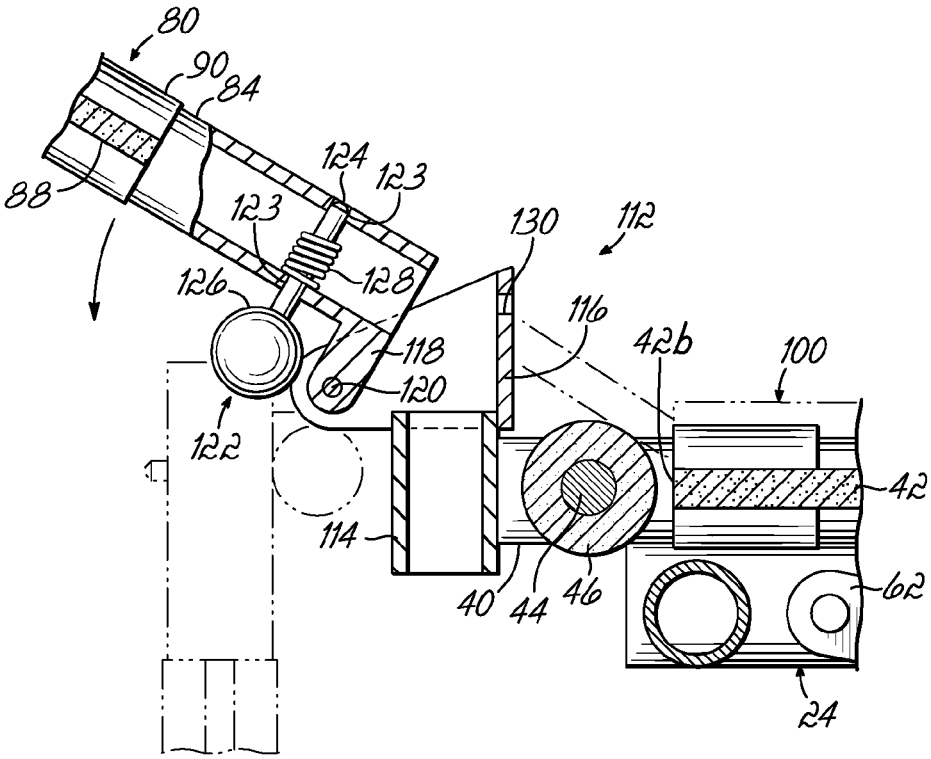

In use, the patient's attendant pulls on the grasp point 126 such that the protrusion 124 disengages from the aperture 130 within the shield member 116. With the protrusion 124 disengaged, the seatback 88 may be rotated about the pivot point, as is shown in FIG. 5B, and until the seatback 88 is extending vertically downward (shown in phantom) from the seat frame 24.

Figure 4D:
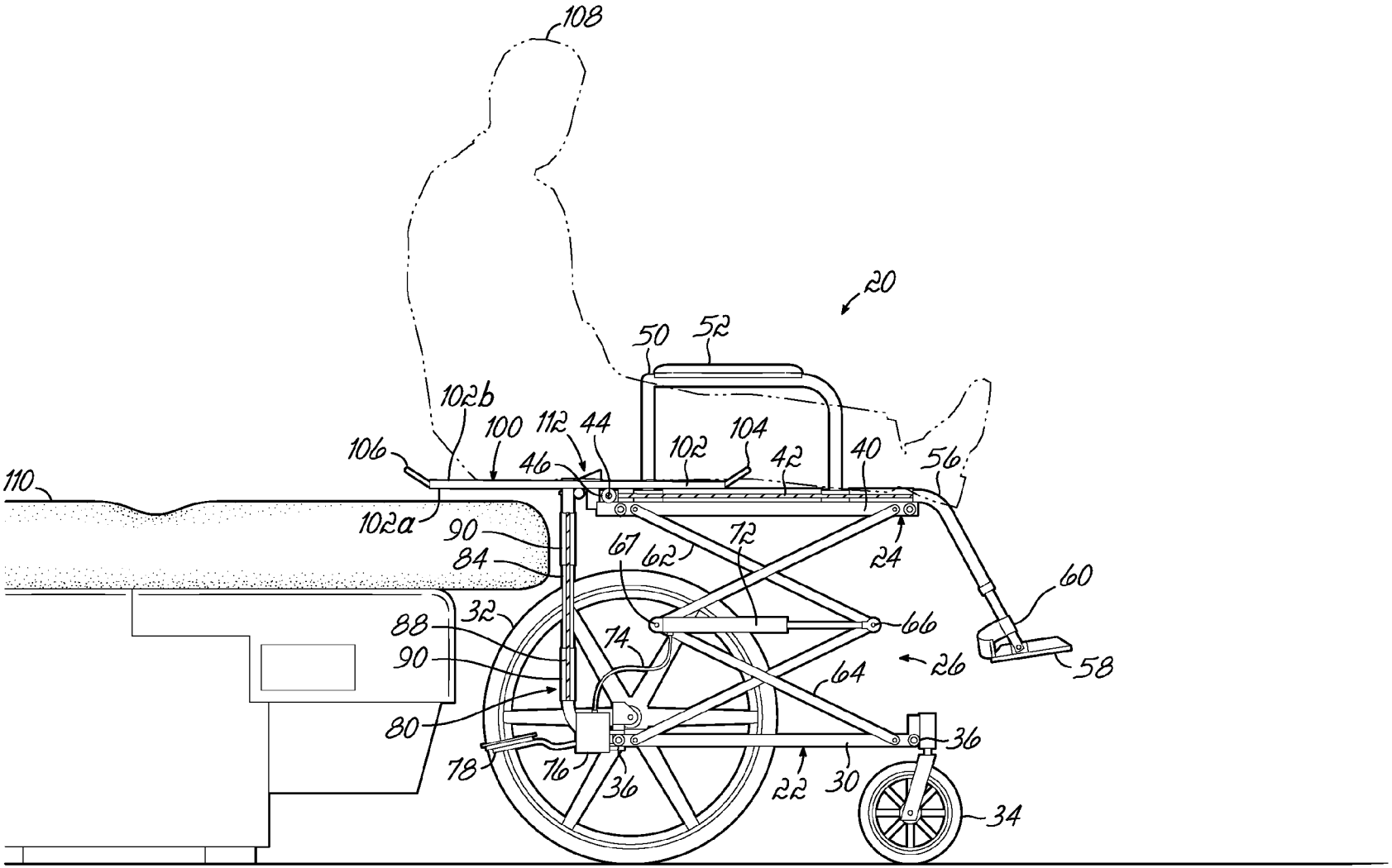
Figure 4E:
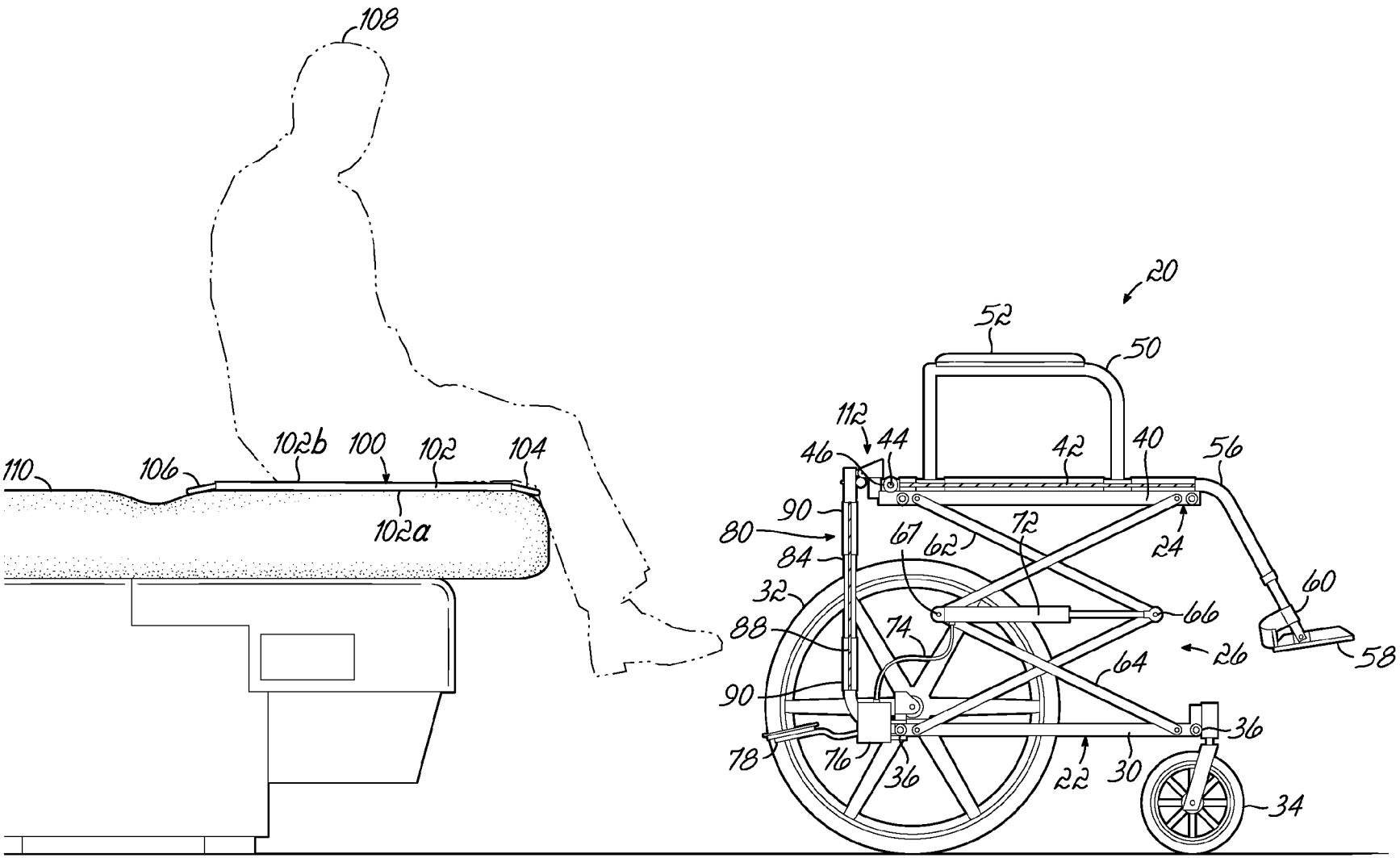
Figure 5C:
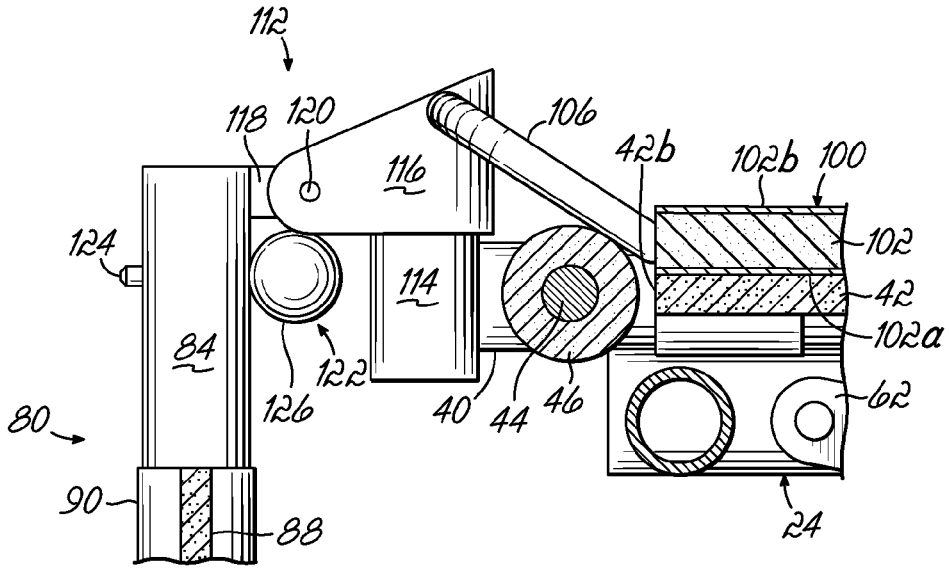
Figure 5D:
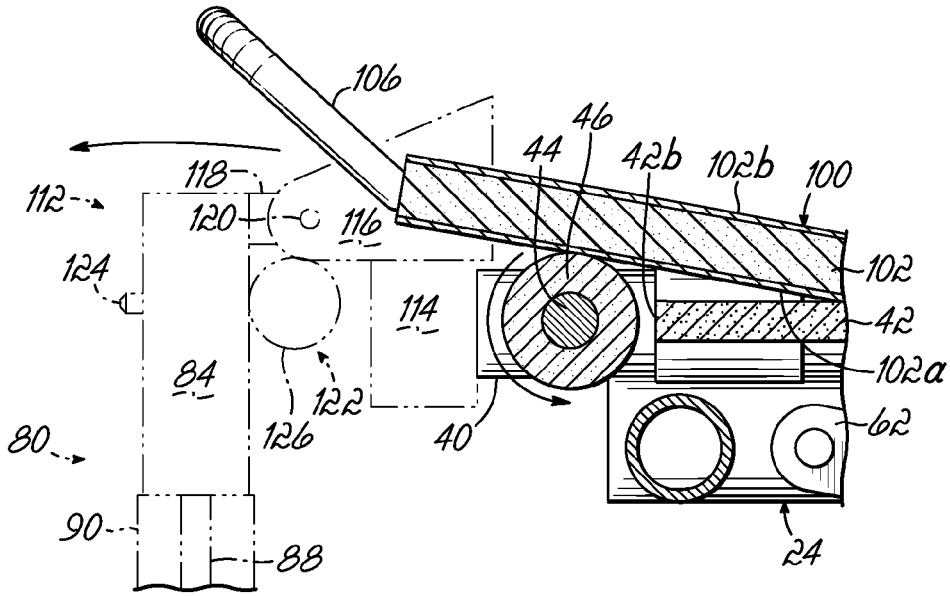

Returning again to FIGS. 4C-4E, and with continued reference to FIGS. 5C-5D, where the seatback 88 is rotated to the downwardly-direct position, the patient's assistant may now move the wheelchair 20 to a location that is closer in proximity to the examining table 110. Then, as shown in FIG. 4D, the patient 108 is transferred from the wheelchair 20 to the examining table 110 by sliding over the back edge 42*b* of the seat 42. The transfer may be accomplished with the patient's attendant pulling on the rearward grips 106 of the transfer mat 100. Because the lower surface 102*a* of the transfer mat 100 is constructed from, or coated with, a material having a slippery texture, the transfer may be accomplished by a single attendant and without injury to the patient 108. The transfer is further facilitated by the rotating pad 46, which spins about the cross-bar 44 as the transfer mat 100 rolls tangentially across and onto the examining table 110.

It should be specifically noted that while the illustrated manner of transferring the patient 108 has included both the transfer mat 100 and the rotating pad 46, it would be possible to transfer the patient 108 with one of these feature alone or without incorporating either of these features.

Once the medical examination is complete, the patient 108 may then be transferred back to the wheelchair 20 by reversing the steps described above. Specifically, the patient's attendant would reposition the wheelchair at the edge of the examining table 110 and then pull on the forward grips 104 of the transfer mat 100 to move the patient 108 across the rotating pad 46 and into the seat 42. The seatback 88 may be rotated back into the first configuration. The spring-loaded pin 122 will automatically extend into the aperture 130 of the shield member 116 in a manner that is well known.

Figure 6:
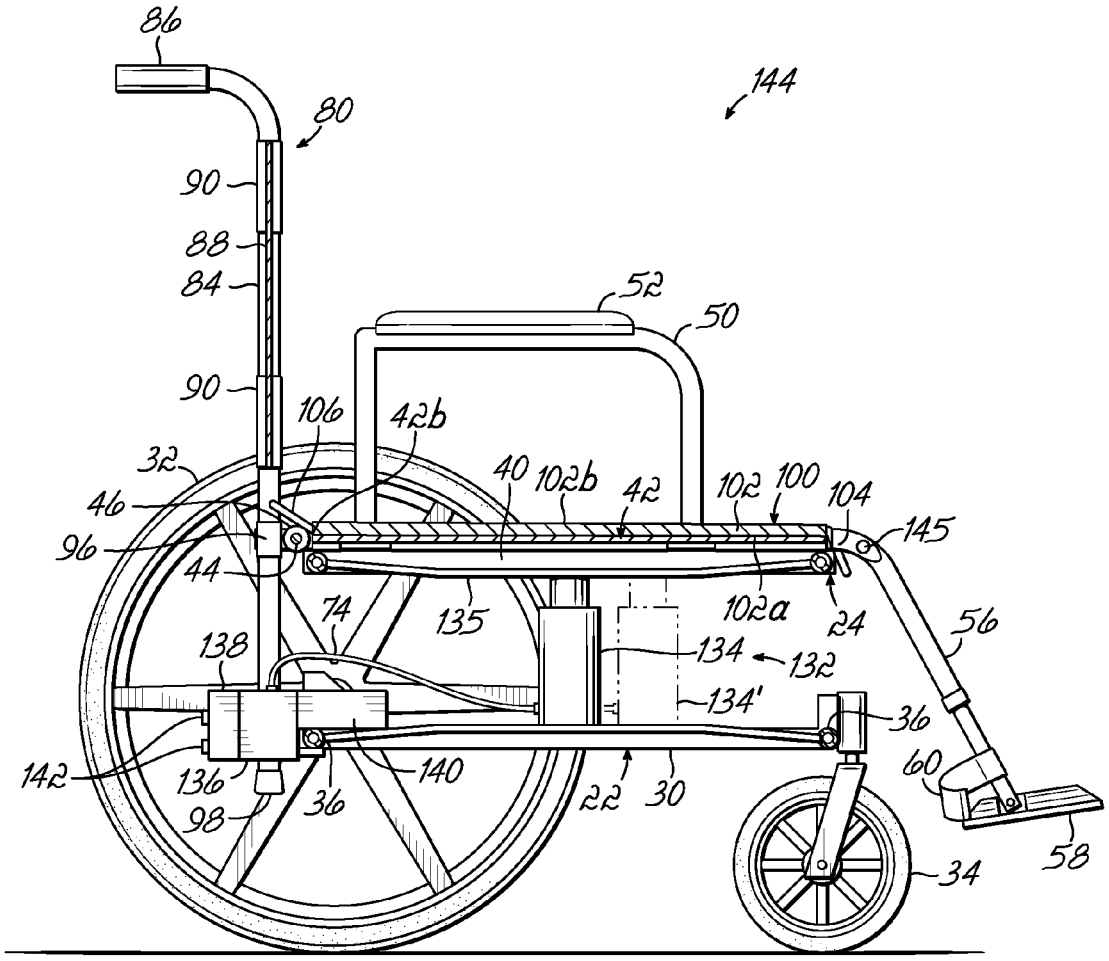
FIG. 6 is a side elevational view of another embodiment of a wheelchair in accordance with the present invention.

One of ordinary skill in the art would readily appreciate that additional alternative structures may be used in effectuating the transfer of the patient 108. For example, a vertical lift mechanism 132 comprised of a centrally disposed hydraulic cylinder 134, as shown in FIG. 6, may be used in place of the pair of lateral scissors of FIG. 1. The centrally disposed hydraulic cylinder 134 is coupled to a supporting frame 135 that is then coupled to the seat frame 24' in a manner that is well known to those of ordinary skill in the art. The hydraulic cylinder 134 is also coupled to the hydraulic pump 136 in a manner similar to the mechanism shown in FIG. 1, or, as shown in FIG. 6, the hydraulic pump 136 may be operable by an electronic controller 138 that is driven by a power source 140. The controller 138 may include an input device, such as push buttons 142 or a switch (not shown), for elevating or lowering of the seat frame 24 relative to the base frame 22. The power source 140 may be a rechargeable battery pack or other energy source that is easily portable and may be attached to the base frame 22 of the wheelchair 144.

FIG. 6 also illustrates a hinge 145 in each leg 54, 56 that is configured to move the legs 54, 56 from the angular position (shown) to a position that is substantially horizontal (not shown). The horizontal position further facilitates transfer of the patient by positioning the patient's legs to be moved across the seat 42.

It would be readily appreciated that in alternative to a single hydraulic cylinder 134, a second hydraulic cylinder 134' (shown in phantom in FIG. 6) may also be used. The two hydraulic cylinders may be offset from center and may more easily accommodate a foldable wheelchair frame structure.

There are also several other mechanisms by which the position of the seatback may be adjusted. By way of further example, two additional embodiments are shown in FIGS. 7A-8B.

Figure 7A:
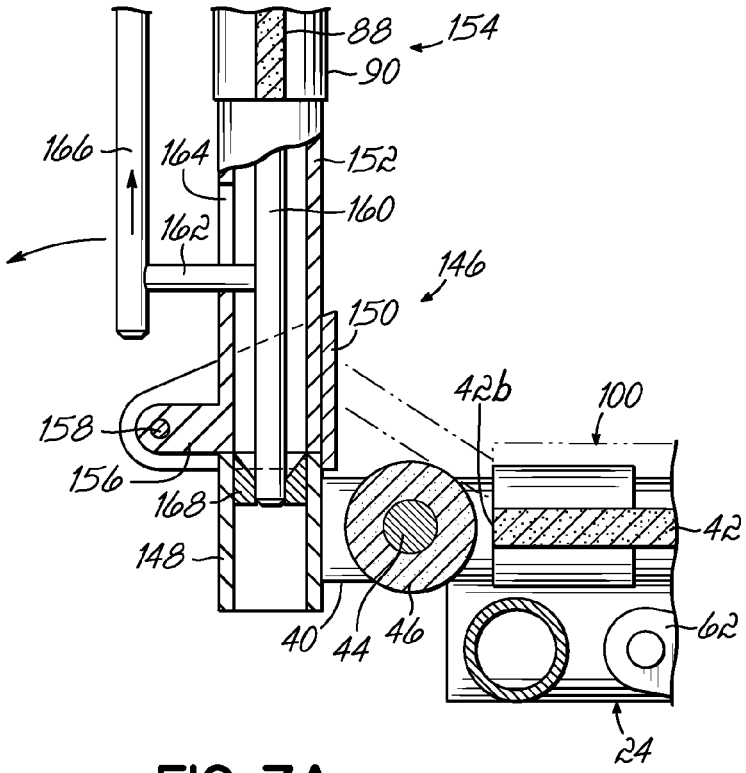
FIGS. 7A-7B are side elevational views of another manner of moving the seatback from the first configuration to a second configuration.
Figure 7B:
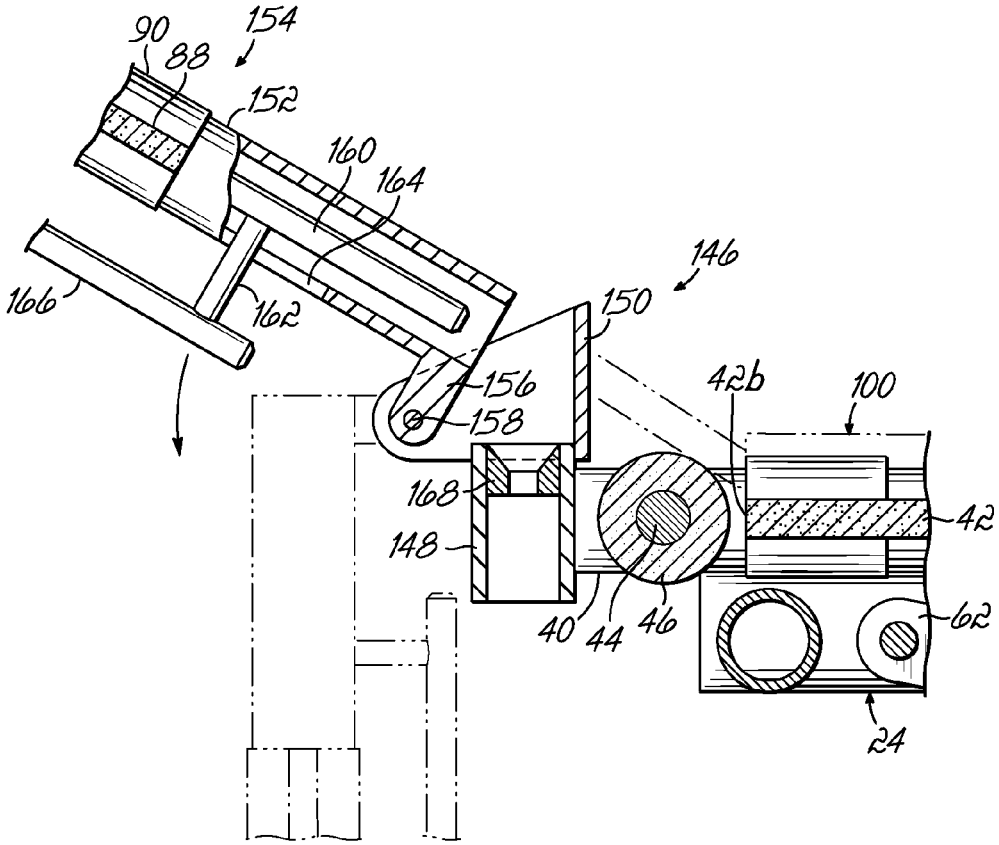

The embodiment of FIGS. 7A-7B is an alternative rotational mechanism 146 that includes a supporting member 148 affixed to the back portion of the side support member 40 of the seat frame 24. A shield member 150 extends upwardly from the supporting member 148 and is constructed with an angular edge. The side member 152 of the seatback assembly 154 includes an extension 156 that is rotatably coupled to the back edge of the shield member 150 at a pivot point, designated by a pin 158.

The side member 152 further includes a shaft 160 extending through the lumen of the side member 152. A cross-bar 162 extends from the shaft 160, through a slot 164 within the side member 152, to a lift-bar 166 that is parallel to the outer surface of the side member 152. In the resting position, the cross-bar 162 resides on the lower surface of the slot 164 and the shaft 160 extends below the bottom edge of the side member 152 and rests in an annular stop 168 within the supporting member 148. In use, the patient's attendant lifts on the lift-bar 166, which resultantly lifts the shaft 160. When the cross-bar 162 contacts the upper surface of the slot 164, the shaft 160 is sufficiently disengaged from the annular stop 168 such that the side member 152 may freely rotate about the pivot axis, as shown in FIG. 7B. Replacement of the seatback assembly 154 may be accomplished by rotating the seatback assembly 154 into the upright position and permitting the shaft 160 to drop back into the rest position and within the annular stop 168.

Figure 8A:
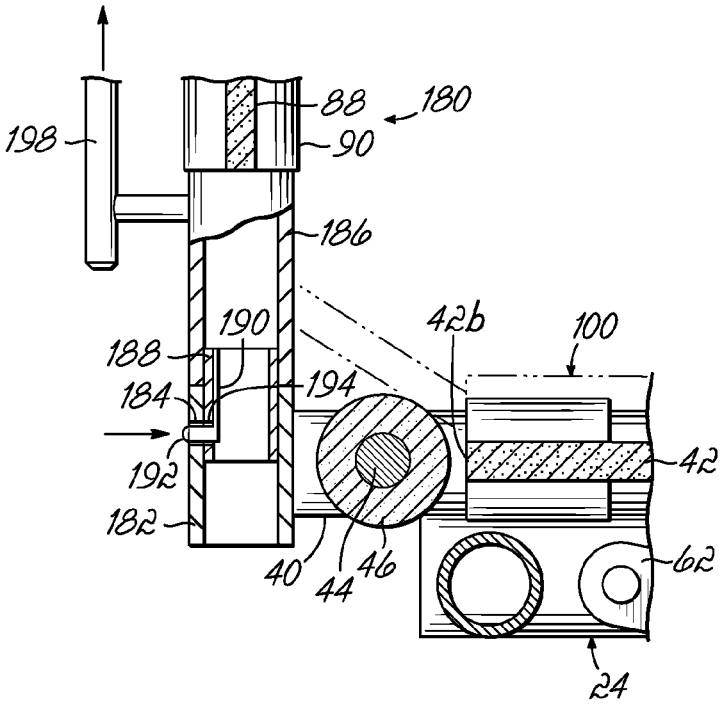
FIGS. 8A-8B are side elevational views of yet another manner of moving the seatback from the first configuration to a second configuration.
Figure 8B:
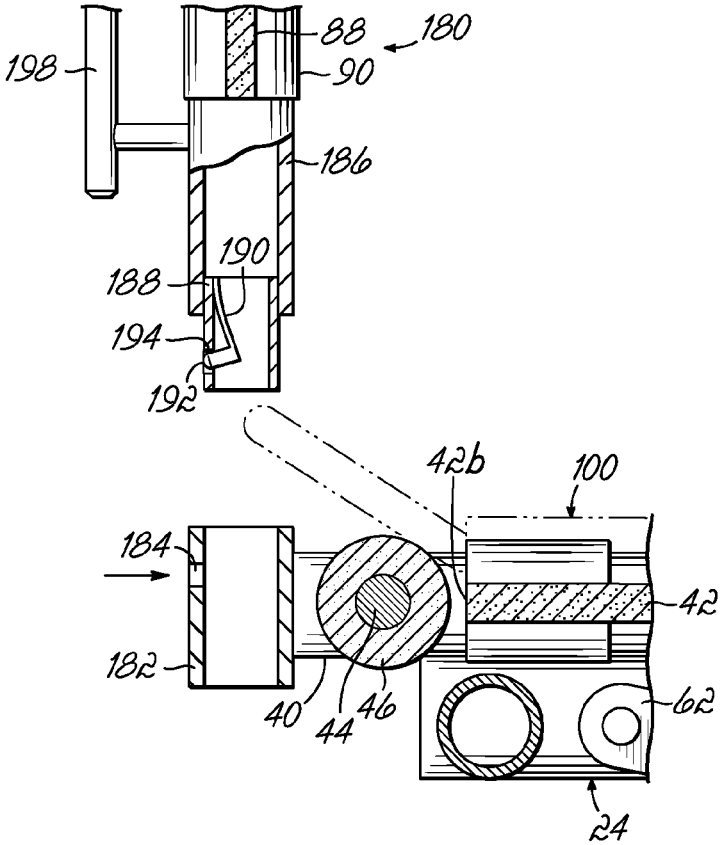

FIGS. 8A and 8B illustrate yet another embodiment of a mechanism for displacing the seatback assembly 180. A rigid sleeve 182 affixed to the back portion of the side support member 40 of the seat frame 24 and includes an aperture 184 in the wall thereof. The side member 186 of the seatback assembly 180 includes an inner tubular member 188 that extends downward from the side member 186 and includes a spring biased pin 190. A first end of the spring biased pin 190 may be coupled to the inner tubular member 188 while a second end of the spring biased pin 190 includes a projection 192 that is biased such that the projection 192 extends through an aperture 194 of the inner tubular member 188. As shown in FIG. 8A, the projection 192 also extends through an aperture 184 in the rigid sleeve 182 when the seatback assembly 180 is in place. However, when transfer of the patient 108 (FIG. 4A) is desired, the patient's attendant may push the projection 192 inwardly until the projection 192 is disengaged from the aperture 184 of the rigid sleeve 182. The seatback assembly 180 is then lifted from the rigid sleeve 182 by pulling upward on the lift bar 198, which allows the patient 108 (FIG. 4A) to be transferred over the back edge 42*b* (FIG. 1) of the seat 42 (FIG. 1). Replacement of the seatback assembly 180 may be accomplished by pushing the projection 192 inwardly and sliding the inner tubular member 188 into the rigid sleeve 182 until the apertures 184, 194 align at which point the biased projection 192 is unconstrained and automatically springs outwardly and engages both apertures 184, 194.

Figure 9:
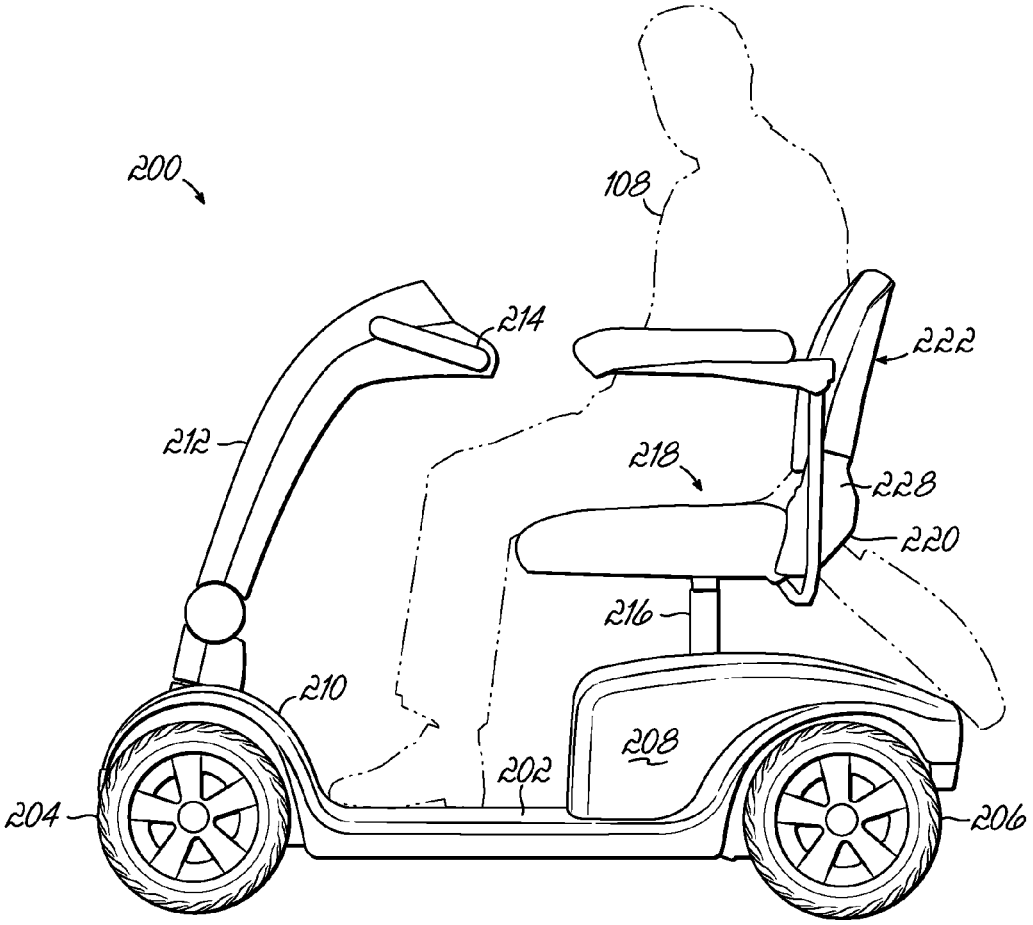
FIG. 9 is a perspective view of one exemplary embodiment of a mobility-scooter in accordance with the present invention.

One of ordinary skill in the art would also appreciate that the particular features described herein for facilitating the transfer of the patient 108 (FIG. 4A) are not limited to use on wheelchairs but may also be used in what has become known as a mobility-scooter. One exemplary embodiment of a mobility-scooter 200 in accordance with the present invention is shown in FIG. 9. Generally, the mobility-scooter 200 includes a base plate 202 that is supported in the front by front wheels 204 and in the back by rear wheels 206, the front and rear wheels 204, 206 being rotatably coupled thereto. An enclosed portion 208 extends upwardly from the base plate 202 near the rear wheels 206 and may cover a drive train mechanism (not shown), controller components (not shown), a motor (not shown), a power source (not shown), or other mechanical components. The enclosed portion 208 is positioned such that there is sufficient space between the enclosed portion 208 and a front fender 210 that the patient's legs may rest and dangle comfortably. A front handlebar assembly 212 may extend upward from the front fender 210 and may include hand grips 214, a throttle (not shown) for activating the motor and propelling the mobility-scooter 200, a braking system for decelerating the mobility-scooter 200, a power switch (not shown), and so forth. The handlebar assembly 212 may be coupled to a steering mechanism (not shown) that allows the patient 108 (FIG. 4A) to steer the mobility-scooter 200 in a desired direction.

Figure 9A:
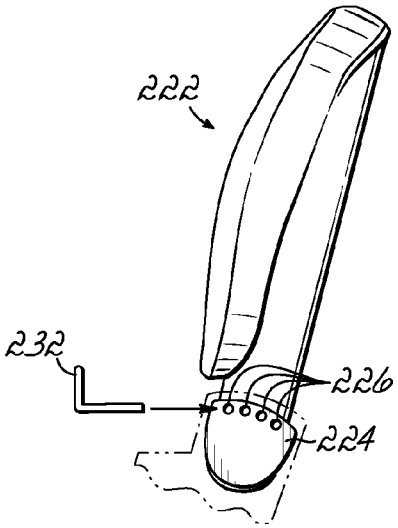
FIG. 9A is a side elevational view of a rotational mechanism for moving the seatback of the seat of the mobility-scooter in FIG. 9.
Figure 9B:
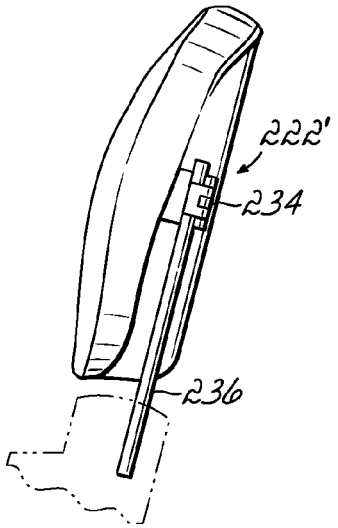
FIG. 9B is an elevational view of a hinge mechanism for the seatback.

A seat post 216 extends vertically upward from the enclosed portion 208, which may be coupled to a hydraulic cylinder (not shown), such as the one shown previously with reference to FIG. 6. In this way, a position of a seat 218 coupled to the seat post 216 may be adjusted for transfer of the patient 108 as described above. The seat 218 may be an upholstered cushion for providing comfort and support to the patient 108. A back edge 220 of the seat 218 may include a hinged seatback 222 that is capable of rotating from the upward, first configuration (shown in solid) to a downward, second configuration (shown in phantom). While various mechanisms exist for rotating the seatback 222 of the mobility-scooter 200 and would be known, one suitable mechanism, shown in FIG. 9A, may be a plate 224 coupled to the seatback 222 and including a plurality of apertures 226 formed in an arcuate shape therein. The plurality of apertures 226 may be aligned with an aperture (not shown) in the seat frame 228 and secured by a pin 232. An alternate embodiment, shown in FIG. 9B, includes a door hinge 234 coupling the seatback 222' to a side bar 236. In this way, the seatback 222' may open, as a door, for patient transfer, while not shown, it would be understood that the opposing lateral side of the seatback 222' may include a latch or other mechanism for coupling to another side bar and prevent the inadvertent opening of the seatback 222'.

While the present invention has been illustrated by a description of various embodiments, and while these embodiments have been described in some detail, they are not intended to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with methods of practicing the present invention as currently known. However, the invention itself should only be defined by the appended claims.

What is claimed is:

1. A transfer chair comprising:

a base frame;

a seat frame;

a seat having a front edge and a back edge, the seat being supported by the seat frame;

a vertical lift mechanism coupling the base frame to the seat frame, the vertical lift mechanism configured to vertically translate the seat from a first height to a second height;

a seatback having first and second configurations, wherein the seatback in the first configuration extends upwardly from the back edge of the seat and the seatback in the second configuration extends downwardly from the back edge of the seat such that a patient may slide over the back edge of the seat; and a transition mechanism for moving the seatback between the first and second configurations.

2. The transfer chair of claim 1, wherein the base frame includes a plurality of wheels.

3. The transfer chair of claim 1, wherein the vertical lift mechanism includes one or more hydraulic cylinders or scissor lift mechanisms.

4. The transfer chair of claim 1 further comprising:

a hydraulic pump configured to actuate the vertical lift mechanism.

5. The transfer chair of claim 1, wherein the transition mechanism includes a pivot point positioned near the back edge of the seat such that the seatback rotates between the first and second configurations about the pivot point.

6. The transfer chair of claim 5, wherein the transition mechanism includes at least one aperture and further comprising:

a seatback frame with at least one aperture in the seatback frame, the at least one aperture in the seatback frame configured to be aligned with the at least one aperture in the transition mechanism; and a pin configured to extend through the aligned apertures and resist rotation of the seatback.

7. The transfer chair of claim 5 further comprising:

a seatback frame;

a shaft having one end extending from the seatback frame;

a lift-bar coupled to the shaft and operable to move the one end of the shaft into the seatback frame; and an annular stop within the seat frame configured to receive the one end of the shaft, wherein the shaft resists rotation of the seatback when the one end extends into the annular stop.

8. The transfer chair of claim 1 further comprising:

a rigid sleeve coupled to the transition mechanism, wherein the seatback is received by the rigid sleeve and slidable relative to the rigid sleeve.

9. The transfer chair of claim 1 wherein the transition mechanism includes a door hinge on a first side of the seatback for moving the seatback between the first and second configurations.

10. The transfer chair of claim 1 further comprising:

a transfer mat having a generally planar surface with a front end and a back end, at least one front grip coupled to the front end of the transfer mat, and at least one back grip coupled to the back end of the transfer mat, the transfer mat being positioned beneath the posterior of the patient and operable to slide the patent between the transfer chair and another platform.

11. The transfer chair of claim 1 further comprising:

a cross-bar extending transversely across the seat frame and having a lengthwise central axis and a rotating pad surrounding the cross-bar wherein the cross-bar, the rotating pad, or both rotate about the lengthwise central axis.

12. The transfer chair of claim 11, wherein the cross-bar with the rotating pad is located near the back edge of the seat.

13. A transfer chair comprising:

a base frame;

a seat frame;

a seat having a front edge and a back edge, the seat being supported by the seat frame;

a vertical lift mechanism coupling the base frame to the seat, whereby the vertical lift mechanism is configured to vertically translate the seat from a first height to a second height; and a moveable seatback extending substantially perpendicular from the back edge of the seat;

the moveable seatback configured to move away from the substantially perpendicular position such that a patient may be transferred between the seat and another platform.

14. The transfer chair of claim 13, wherein a hydraulic pump actuates the vertical lift mechanism.

15. The transfer chair of claim 13, wherein the moveable seatback includes a pivot point positioned near the back edge of the seat such that the seatback rotates about the pivot point away from the substantially perpendicular position.

16. The transfer chair of claim 13 further comprising:

a rigid sleeve coupled with the seat frame such that the moveable seatback may slide relative to the rigid sleeve away from the substantially perpendicular position.

17. A method of transferring a patient between a transfer chair and a platform, the method comprising:

elevating a seat of the transfer chair to a height that is similar to a height of the platform;

positioning the transfer chair such that a back edge of the seat is adjacent an edge of the platform;

moving a seatback from an upright position to a downward-directed position and transferring the patient between the transfer chair and the platform by sliding the patient over the back edge of the seat.

18. The method accordingly to claim 17, wherein moving the seatback includes rotating or sliding the seatback relative to the seat.

19. The method according to claim 17, wherein positioning the transfer chair includes rolling the transfer chair on a plurality of wheels coupled to the transfer chair.

20. The method according to claim 17 further comprising:

pulling on a transfer mat that is positioned beneath the patient when sliding the patient.

21. The method according to claim 17, wherein the patient slides into the seat and method further comprises:

lowering the seat; and moving a seatback in an upright position for transporting the patient to another location.

* * * * *